US009744096B2

(12) United States Patent
Park et al.

(10) Patent No.: US 9,744,096 B2
(45) Date of Patent: Aug. 29, 2017

(54) FACE MASSAGING DEVICE

(75) Inventors: Changman Park, Seoul (KR); Changkeun Lee, Seoul (KR); Taehong Shin, Seoul (KR); Seunghwan Yi, Seoul (KR); Cheonghwan Hwang, Seoul (KR); Wooram Park, Seoul (KR); Taekjin Oh, Seoul (KR); Byungyoung Kang, Seoul (KR)

(73) Assignee: AMOREPACIFIC CORPORATION, Seoul (KR)

( * ) Notice: Subject to any disclaimer, the term of this patent is extended or adjusted under 35 U.S.C. 154(b) by 255 days.

(21) Appl. No.: 14/232,471

(22) PCT Filed: Jul. 13, 2012

(86) PCT No.: PCT/KR2012/005555

§ 371 (c)(1),
(2), (4) Date: Jan. 13, 2014

(87) PCT Pub. No.: WO2013/009119

PCT Pub. Date: Jan. 17, 2013

(65) Prior Publication Data

US 2014/0142477 A1 May 22, 2014

(30) Foreign Application Priority Data

Jul. 13, 2011 (KR) ..... 20-2011-0006379 U

(51) Int. Cl.
*A61H 23/02* (2006.01)
*A61H 23/00* (2006.01)
(Continued)

(52) U.S. Cl.
CPC ..... *A61H 23/02* (2013.01); *A61H 7/004* (2013.01); *A61H 23/006* (2013.01);
(Continued)

(58) Field of Classification Search
CPC .. A61H 23/00; A61H 2205/022; A61H 23/02; A61H 2201/5002; A61H 2201/5005
See application file for complete search history.

(56) References Cited

U.S. PATENT DOCUMENTS 2,755,803 A * 7/1956 Dorsey ..... A61F 7/02 128/858
3,557,781 A * 1/1971 Kaye, Sr. ..... A61H 23/0263 601/71

(Continued)

FOREIGN PATENT DOCUMENTS

KR 20-0184898 Y1 6/2000
KR 200184898 Y1 * 6/2000

(Continued)

OTHER PUBLICATIONS

International Search Reporpt of PCT/KR2012/005555 dated Jan. 28, 2013.

*Primary Examiner* — Justine Yu
*Assistant Examiner* — Christopher Miller

(57) ABSTRACT

Disclosed is a massage device for human face for driving vibration modules of a mask individually even without an external power supply to massage local or overall area of the human face and for driving vibrators of the vibration modules in various vibration pattern of pulse width modulation (PWM) to provide various massage functions such as appeasing, rubbing, picking, pressing, and knocking similar to massage carried out by human hands. The facial massage device includes a mask having an accommodation space therein and at least one vibration module accommodate in the accommodation space of the mask and having own power supply for allowing an independent operation.

4 Claims, 15 Drawing Sheets

(51) Int. Cl.
*A61H 7/00* (2006.01)
*A61H 39/04* (2006.01)

(52) U.S. Cl.
CPC ..... *A61H 23/0263* (2013.01); *A61H 39/04* (2013.01); *A61H 2201/0188* (2013.01); *A61H 2201/165* (2013.01); *A61H 2201/5002* (2013.01); *A61H 2201/5005* (2013.01); *A61H 2205/022* (2013.01)

(56) References Cited

U.S. PATENT DOCUMENTS 4,052,981 A * 10/1977 Bachmann ..... A61H 23/0263 601/134
5,072,724 A * 12/1991 Marcus ..... A61H 23/0245 601/148
5,099,829 A * 3/1992 Wu ..... A61H 39/002 128/907
5,302,806 A * 4/1994 Simmons ..... A41D 13/0051 219/211
5,344,437 A * 9/1994 Pistay ..... A61F 7/10 5/639
6,093,164 A * 7/2000 Davis ..... A61H 23/0263 601/46
6,537,308 B2 * 3/2003 Burkhart ..... A61F 7/02 2/171.2
6,554,787 B1 * 4/2003 Griffin ..... A61F 7/02 601/70
7,182,739 B2 * 2/2007 Kopanic ..... A61F 7/03 601/15
7,630,203 B1 * 12/2009 Chen ..... G06K 19/077 235/492
7,637,878 B2 * 12/2009 Lin ..... A61H 23/0263 601/37
2004/0260211 A1 * 12/2004 Maalouf ..... A61H 23/02 601/15
2005/0081863 A1 * 4/2005 Lin ..... A61F 5/41 128/844
2005/0234373 A1 * 10/2005 Khalaf ..... A61H 23/0263 601/71
2006/0178602 A1 * 8/2006 Teng ..... A61H 19/34 601/70
2006/0211963 A1 * 9/2006 Spirk ..... A61H 23/0254 601/93
2006/0258963 A1 * 11/2006 Kopanic, Jr. ..... A61F 7/03 601/46
2006/0287615 A1 * 12/2006 Yu ..... A61H 39/002 601/15
2007/0179414 A1 * 8/2007 Imboden ..... A61H 19/00 601/72
2007/0255187 A1 * 11/2007 Branch ..... A61F 7/02 601/15
2008/0208085 A1 * 8/2008 Nan ..... A61H 7/005 601/46
2009/0062700 A1 * 3/2009 Lin ..... A61H 23/0263 601/37
2009/0069727 A1 * 3/2009 Neustaedter ..... A61H 23/0263 601/46
2009/0259168 A1 * 10/2009 Prizant ..... A61H 23/0263 604/22
2010/0249637 A1 * 9/2010 Walter ..... A61H 23/02 600/544
2011/0208279 A1 * 8/2011 Sanker ..... A61F 7/02 607/109
2012/0022411 A1 * 1/2012 Wu ..... A61H 23/02 601/15
2012/0023785 A1 * 2/2012 Barnes ..... A61F 5/14 36/141
2012/0116273 A1 * 5/2012 Nan ..... A61H 19/34 601/46
2012/0184884 A1 * 7/2012 Dyer ..... A61H 19/50 601/46

FOREIGN PATENT DOCUMENTS

KR 20-0219489 Y1 4/2001
KR 20-0219490 Y1 4/2001
KR 10-0291011 B1 6/2001

* cited by examiner

-PRIOR ART-

FACE MASSAGING DEVICE

CROSS REFERENCE RELATED APPLICATION

This application claims foreign priority of Korean Patent Application No. 20-2011-0006379, filed on Jul. 13, 2011, which is incorporated by reference in its entirety into this application.

BACKGROUND OF THE INVENTION

1. Field of the Invention

The present invention relates to a massage device for human face, and more particularly, to a massage device for human face for driving vibration modules of a mask individually even without an external power supply to massage local or overall area of the human face and for driving vibrators of the vibration modules in various vibration pattern of pulse width modulation (PWM) to provide various massage functions such as appeasing, rubbing, picking, pressing, and knocking similar to massage carried out by human hands.

2. Description of the Related Art

In general, in order to improve elasticity of skin and to prevent aging, various cosmetics and functional cosmetics such as massage cream are used and professional massage shops performing skin care using the functional cosmetics are increased.

Moreover, a massage device (hereinafter, referred to as a "facial massage device") stimulating human face is provided and is configured to attach a vibration motor to a face-shaped mask to apply vibration to the human face such that blood can be easily circulated and skin aging can be delayed.

FIG. 1 shows an existing facial massage device, and as illustrated in FIG. 1 the existing skin facial massage device includes a mask 10, an electrode node (not shown) installed to the mask 10, an LED indicators 20, an input terminal 30, a controller 40, and wearing bands 50.

The mask 10 is made of very soft silicon material having a standard face shape enough to cover human face.

The electrode node is installed inside the mask 10 and stimulates the human face by making electric current flow through the human face.

The LED indicators 20 are installed on the outer side of the mask 10 to visually indicate whether the electrode node is operated normally.

The input terminal 30 receives electric power and various control signals required to drive the electrode node and the LED indicators 20 from the controller 40.

The controller 40 supplies driving electric power to the mask 10, allows a user to input various preset values, and transmits various control signals to a driving circuit board (not shown) according to the input preset values.

Finally, the wearing bands 50 are attached to lateral sides of the mask 10 such that a user can wear the mask on his/her face.

However, the existing facial massage device is operated only when being provided with the controller because the mask is electrically connected through coupling between the input terminal of the mask and a connector of the controller and electric power is applied from the controller to the electrode node of the mask. In other words, in order to operate the electrode node of the mask for use of the facial massage functions, the facial massage device must be provided with the controller, and due to this it is inconvenient to use and carry the existing facial massage device and overall operation of the facial massage device is impossible when the battery mounted to the controller is discharged.

Moreover, since the existing facial massage device is a device in which the electrode node is driven or stopped by the electric power supplied from the controller, it is impossible to apply massage functions to a specific portion of face or vice versa. For example, it is impossible for a user to receive the massage functions to portions of his/her face excluding a wound. Due to this, a user must avoid using the existing massage device or must be massaged while avoiding the massage device.

Moreover, the existing facial massage device controls stimulation strength to a portion of face by adjusting current applied to the electrode node but cannot provide various stimulations like massage carried out by hands, resulting in providing only simple massage functions.

BRIEF SUMMARY OF THE INVENTION

The present invention has been made to overcome the above problem and provide a facial massage device including a plurality of vibration modules independently driven by own power supplies and operated with only a mask regardless of an external power supply.

The present invention also provides a facial massage device allowing a user to select a portion to which massage function is applied such as to select a specific portion of user's face or to exclude the other portion of the face.

The present invention also provides a facial massage device for providing various massage functions such as appeasing, rubbing, picking, pressing, and knocking by controlling vibration patterns of the vibration modules.

In order to achieve the foregoing and/or other aspects of the present invention, there is provided a facial massage device, including: a mask having an accommodation space therein; and at least one vibration module accommodated in the accommodation space of the mask and having own power supply for allowing an independent operation.

The mask comprises a first mask and a second mask circumstances of which are fixed to each other to form the accommodation space therein, and at least one of the first mask and the second mask has at least one of insertion holes for insertion and withdraw of the vibration module.

Moreover, the vibration module includes: a printed circuit board; a vibrator installed on the printed circuit board; a drive mounted on the printed circuit board to provide vibration force of the vibrator when electric power is supplied; a battery supplying the electric power to the drive; a supporting plate integrally connecting the printed circuit board to the battery; a power connecting member electrically connecting power terminals of the battery to power terminals of the drive on the printed circuit board; and an insulator attached to a contact region between the power terminals of the battery and the power connecting member and allowing contact between the power terminals of the battery and the power connecting member when the vibration module is separated from the battery.

The vibration module further includes a controller controlling the drive to control the vibration state of the vibrator, and the controller controls the drive in pulse width modulation (PWM) such that at least two different pulses are outputted to the drive while the at least two different pulses are sequentially output according to a preset reference or only one pulse is continuously outputted.

The facial massage device further includes a wearing unit for allowing the mask to be put on human head.

The facial massage device of the present invention can exhibit massage functions by driving a plurality of vibration modules of a mask which are independently driven by own power supply even without a separated external power supply so that user convenience and mobility can be improved.

Moreover, since a specific portion of human face is massaged or the other portion excluding the specific portion is massaged by user's choice, the facial massage device of the present invention can provide proper massage functions according to face skin conditions and personal tendency.

In addition, the facial massage device of the present invention can provide various massage function such as appeasing, rubbing, picking, pressing, and knocking by controlling vibration patterns of the vibration modules so that massage functions and effects thereof can be maximized.

BRIEF DESCRIPTION OF THE DRAWINGS

The objects, features and advantages of the present invention will be more apparent from the following detailed description in conjunction with the accompanying drawings, in which.

DETAILED DESCRIPTION OF THE INVENTION

Hereinafter, a facial massage device according to an exemplary embodiment of the present invention will be described in detail with reference to the accompanying drawings.

Figure 1:
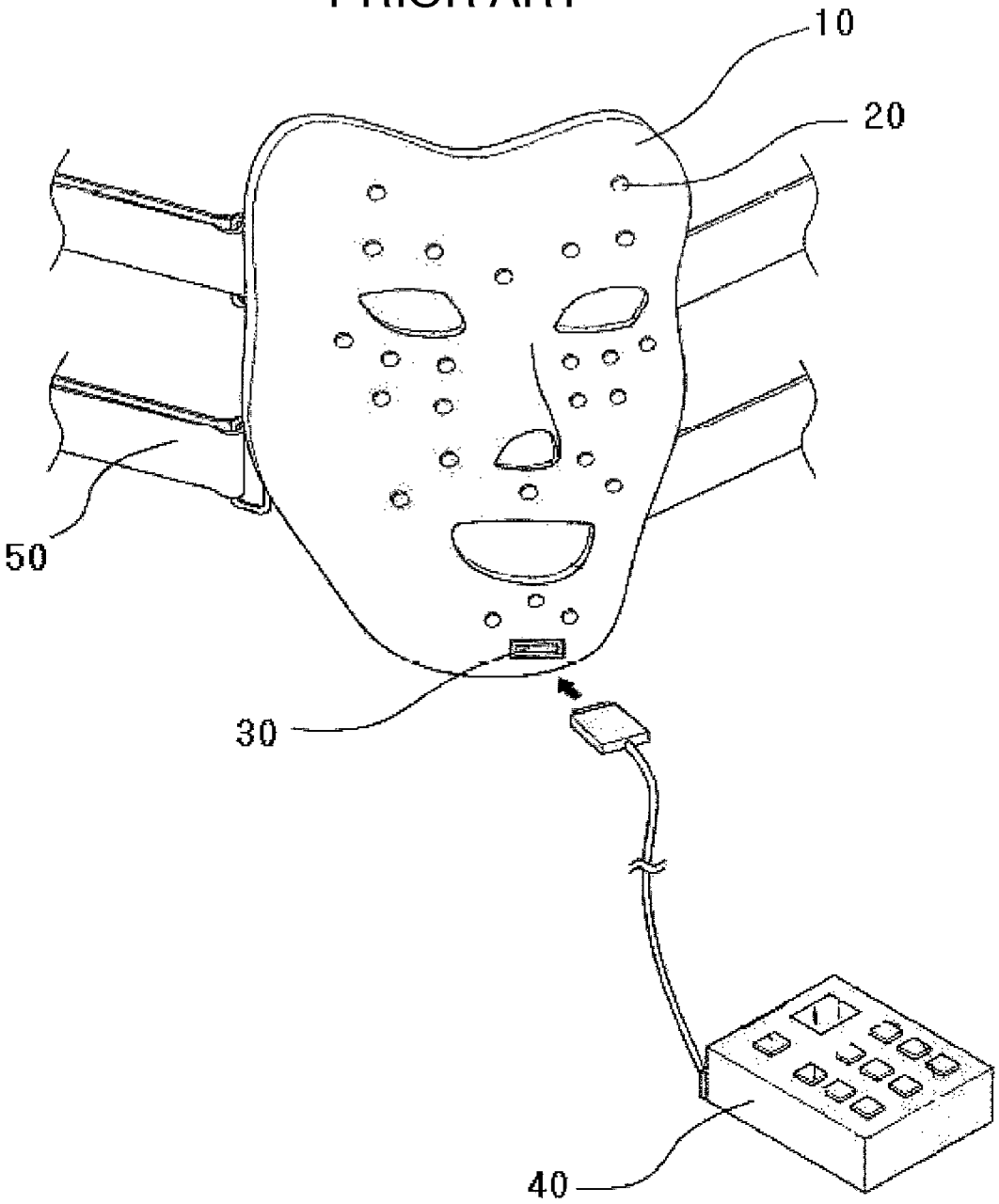
FIG. 1 is a perspective view illustrating an existing facial massage device.
Figure 2:
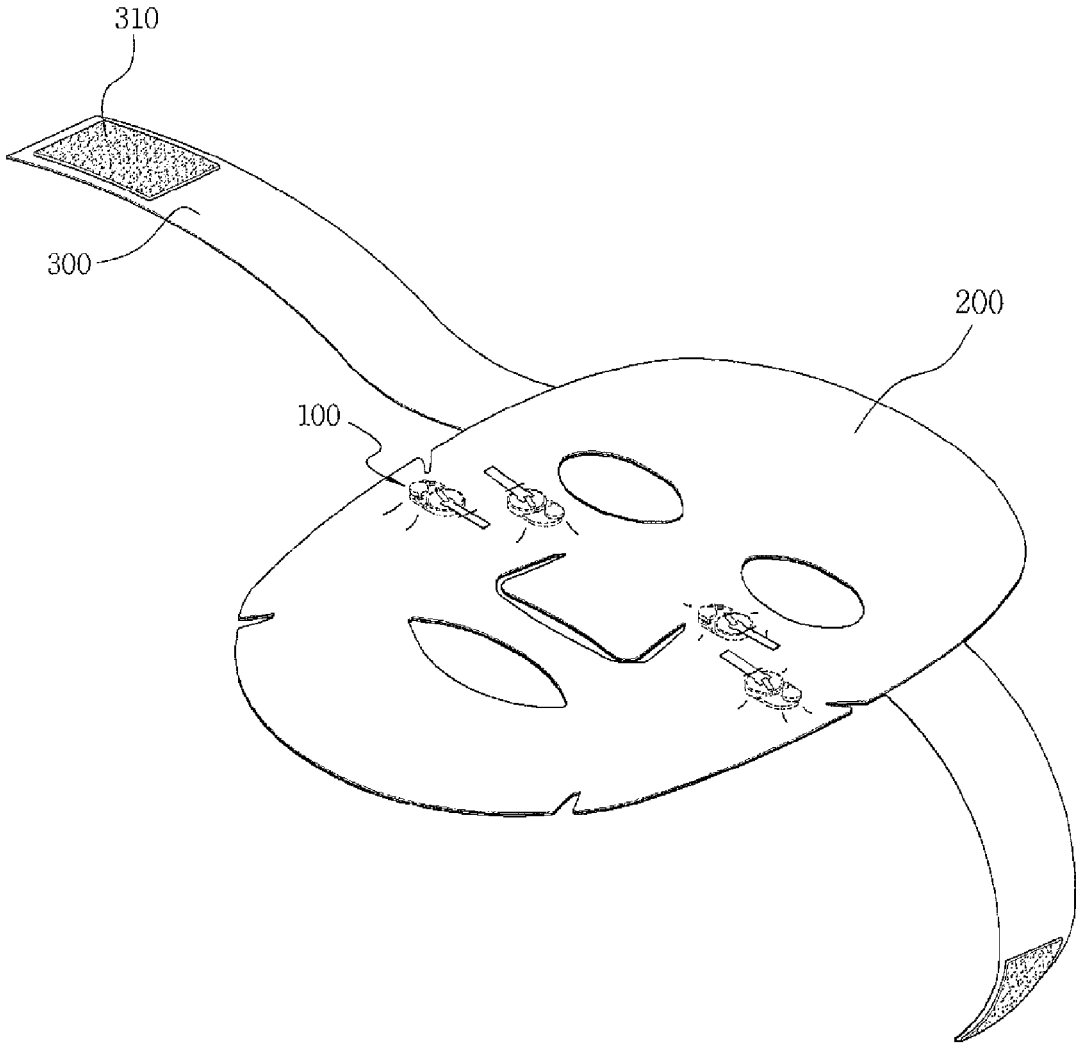
FIG. 2 is a perspective view illustrating a facial massage device according to an exemplary embodiment of the present invention.
Figure 3:
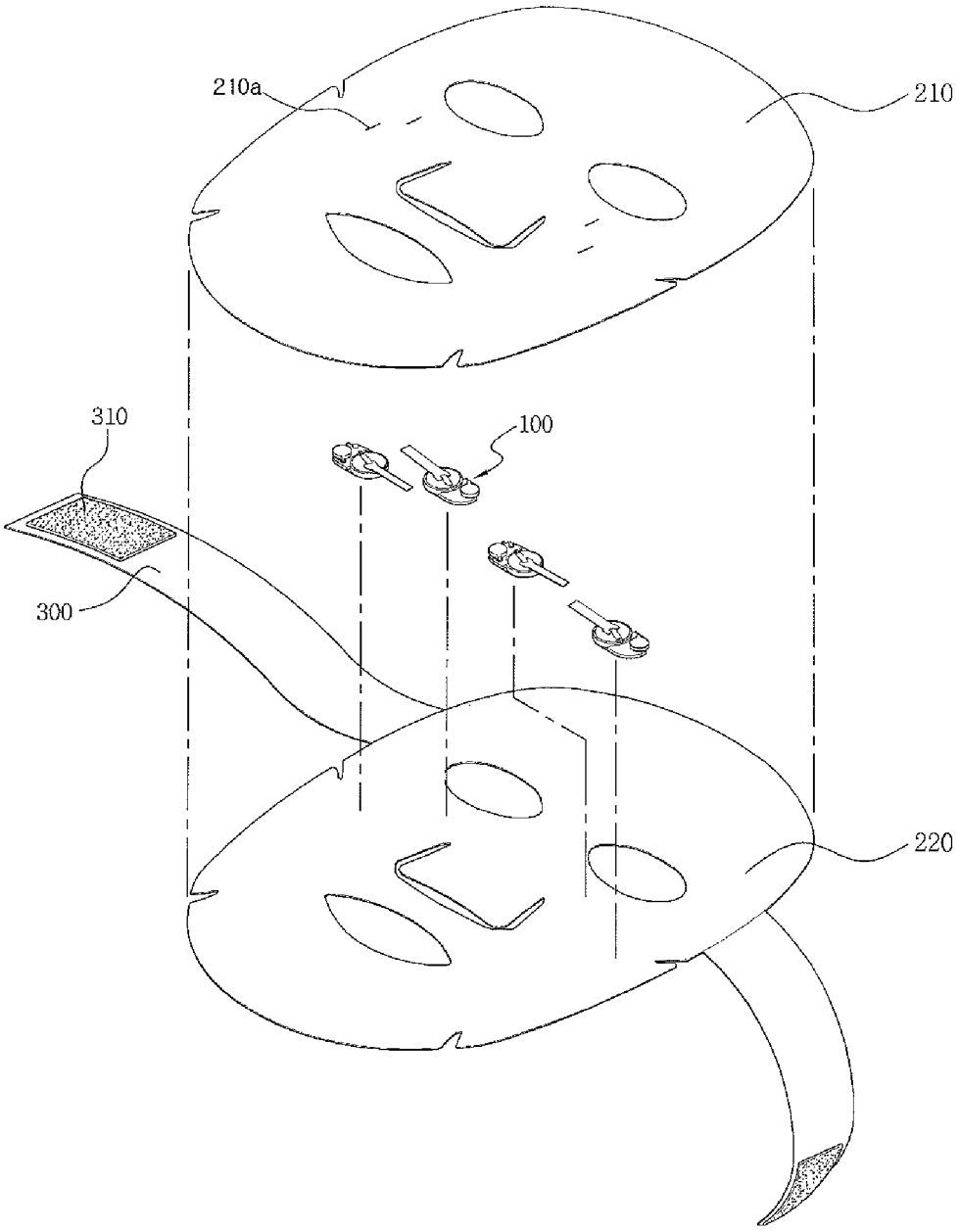
FIG. 3 is an exploded perspective view illustrating the facial massage device according to the exemplary embodiment of the present invention.
Figure 4:
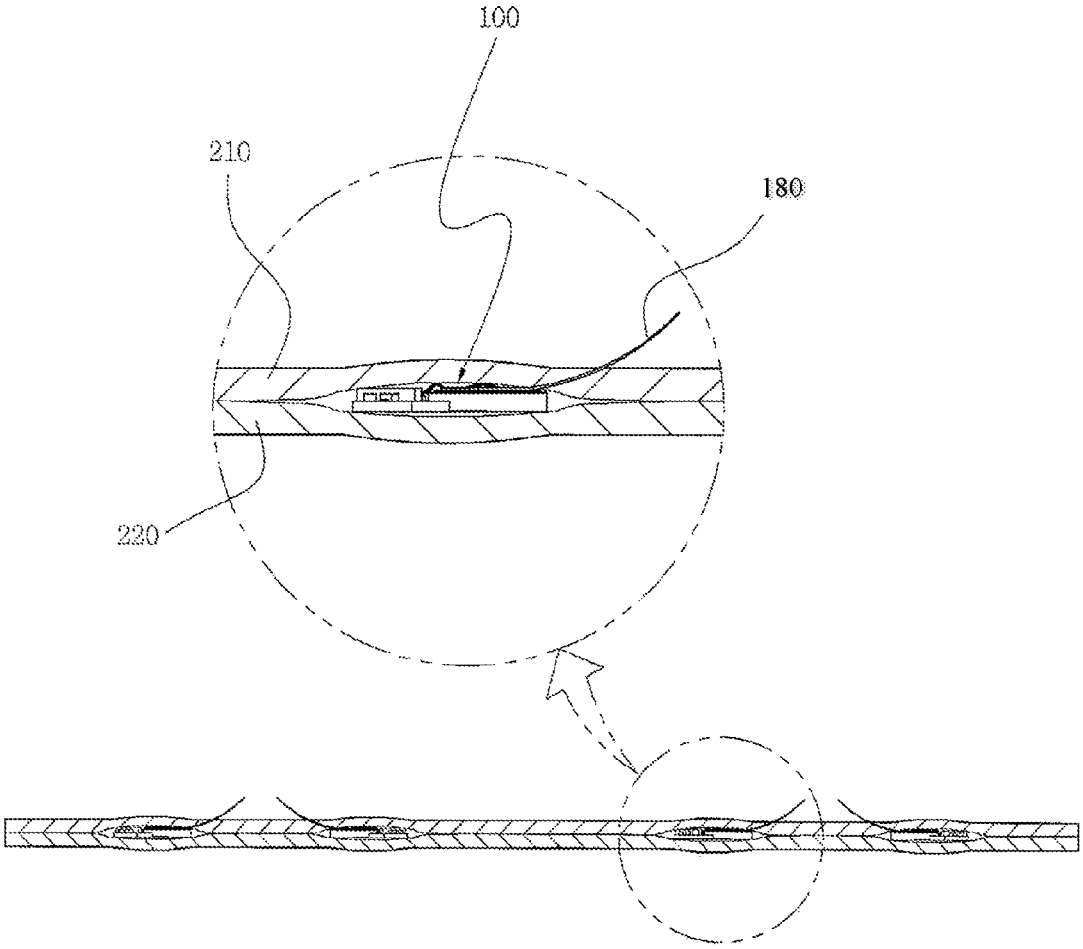
FIG. 4 is a sectional view taken along the line A-A of FIG. 2.
Figure 5:
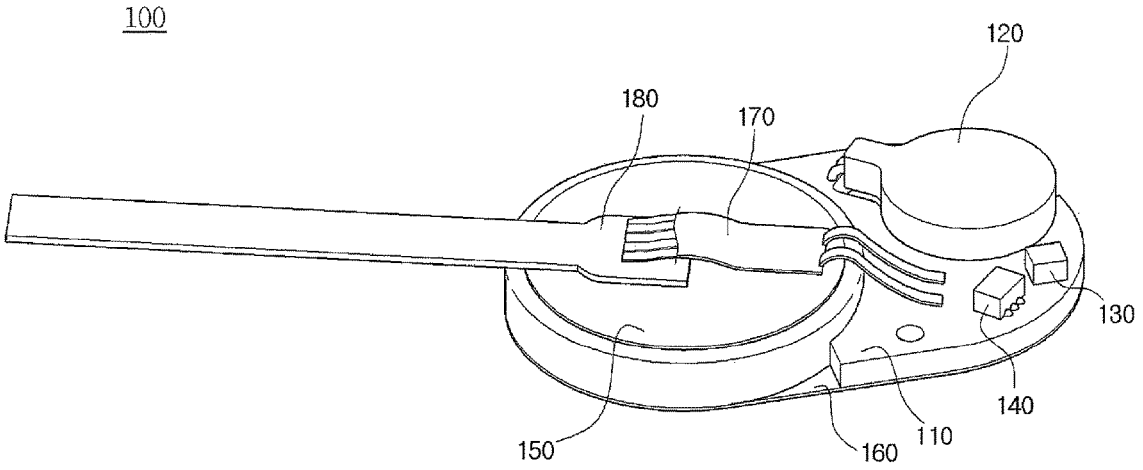
FIG. 5 is a perspective view illustrating a vibration module of the facial massage device according to the exemplary embodiment of the present invention.
Figure 7A:
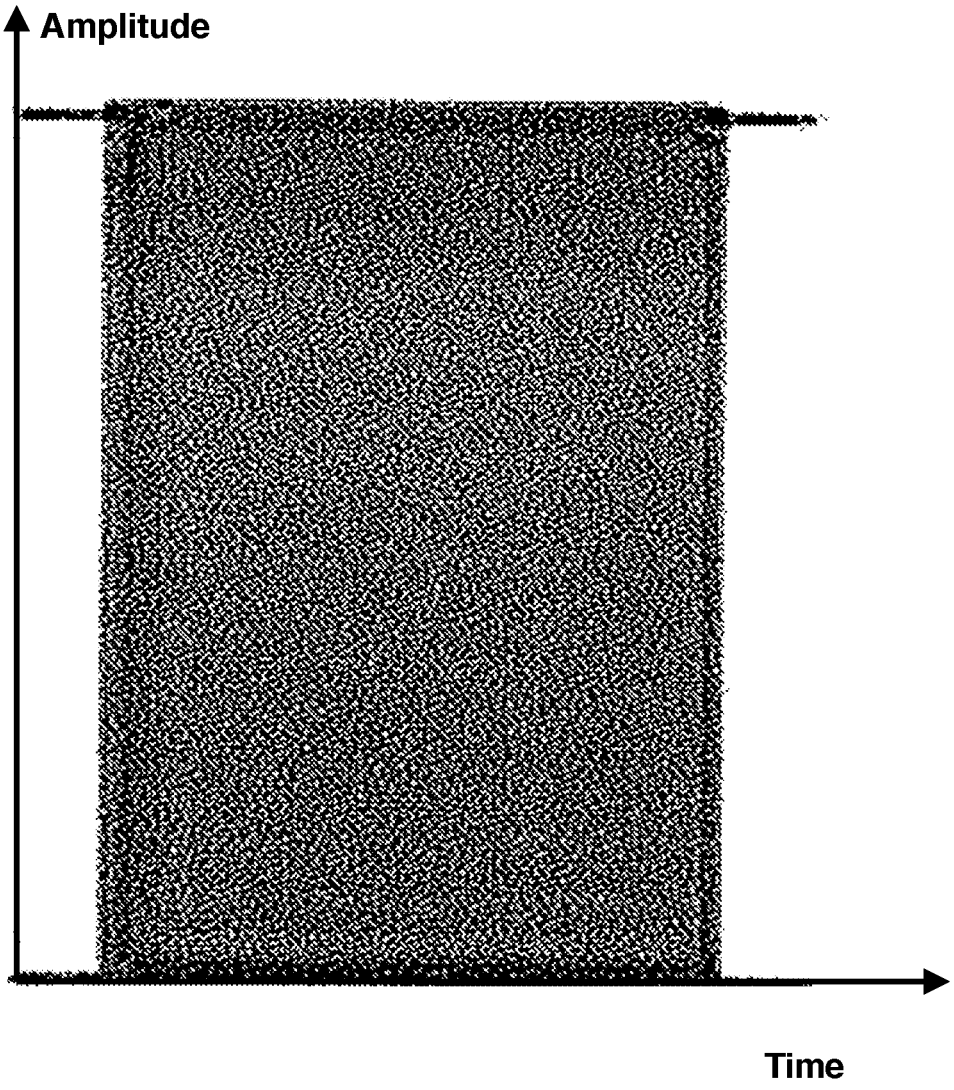
FIGS. 7A to 7H are views showing massage operations of a facial massage device according to the exemplary embodiment of the present invention, which vibrates in different types according to output pulses outputted from a controller of the vibrator to a drive of the device.
Figure 7B:
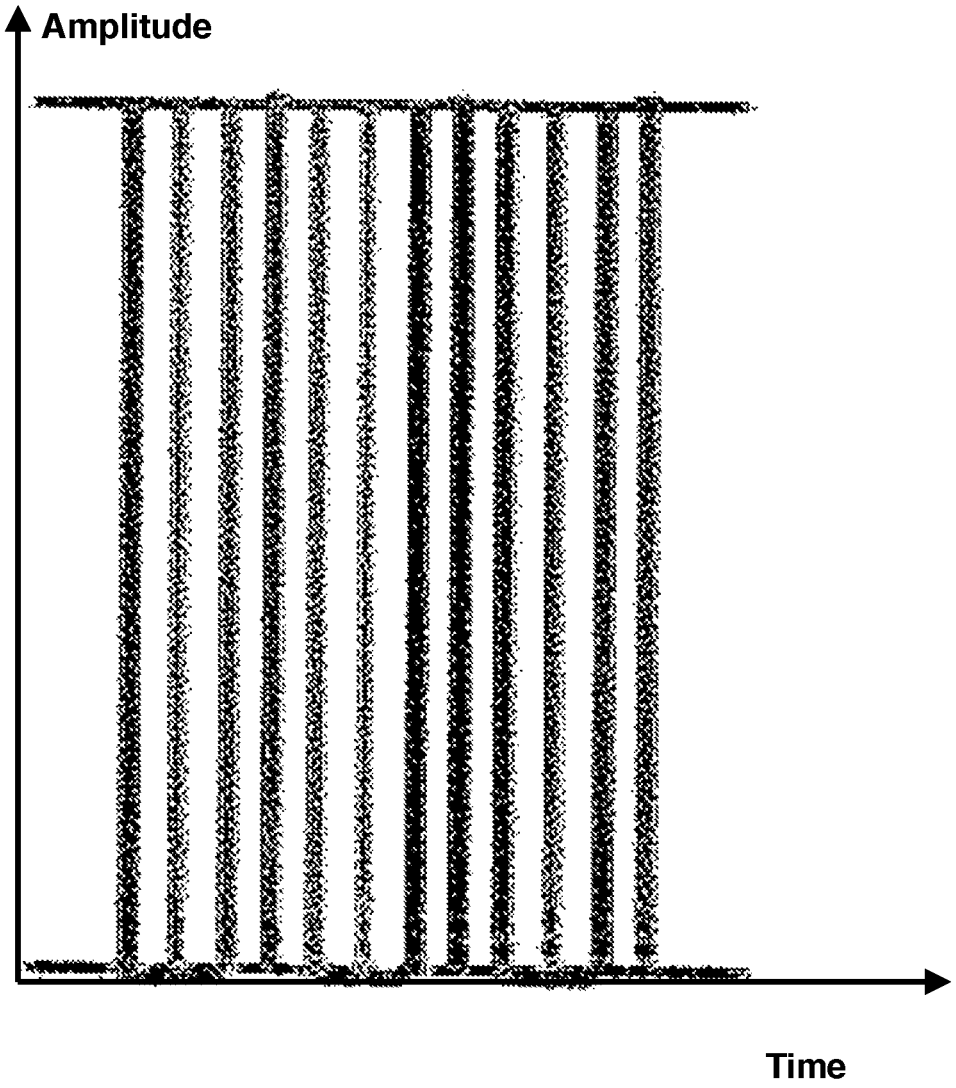
Figure 7C:
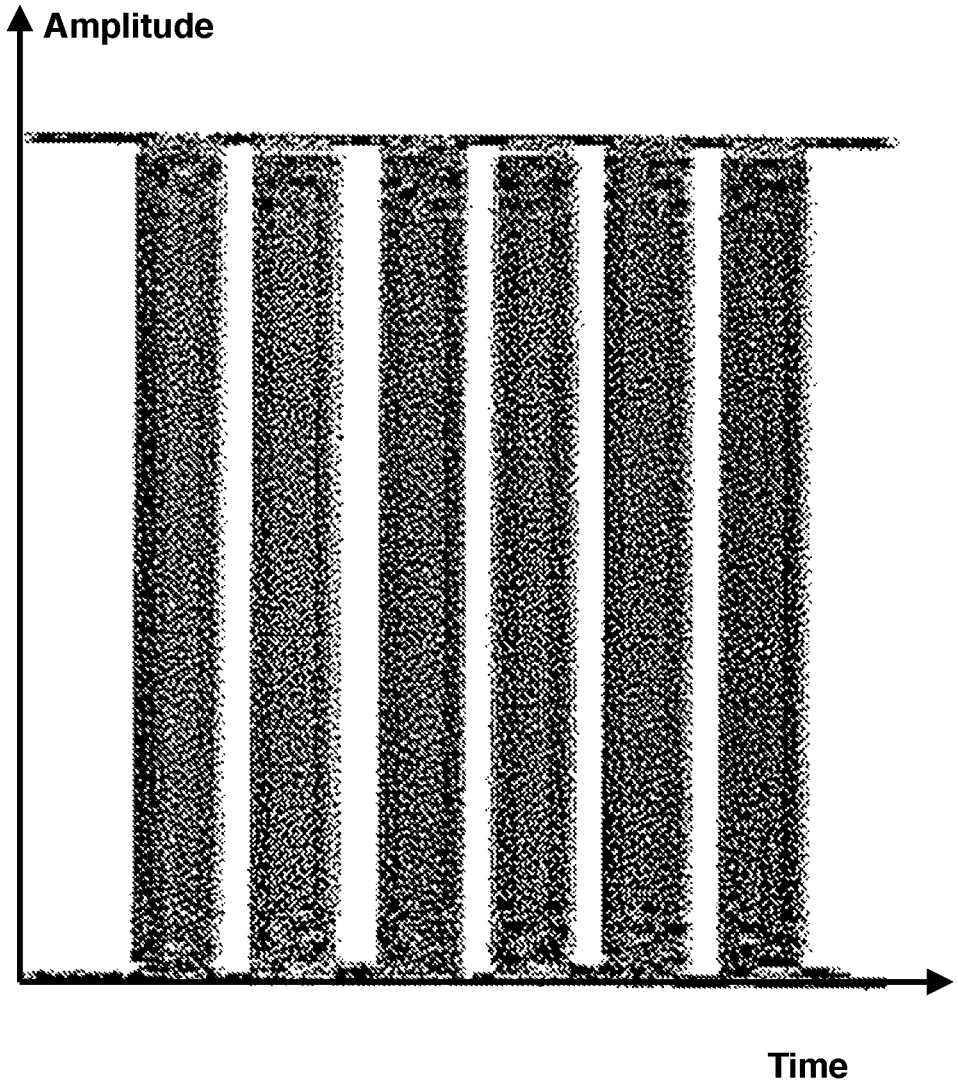
Figure 7D:
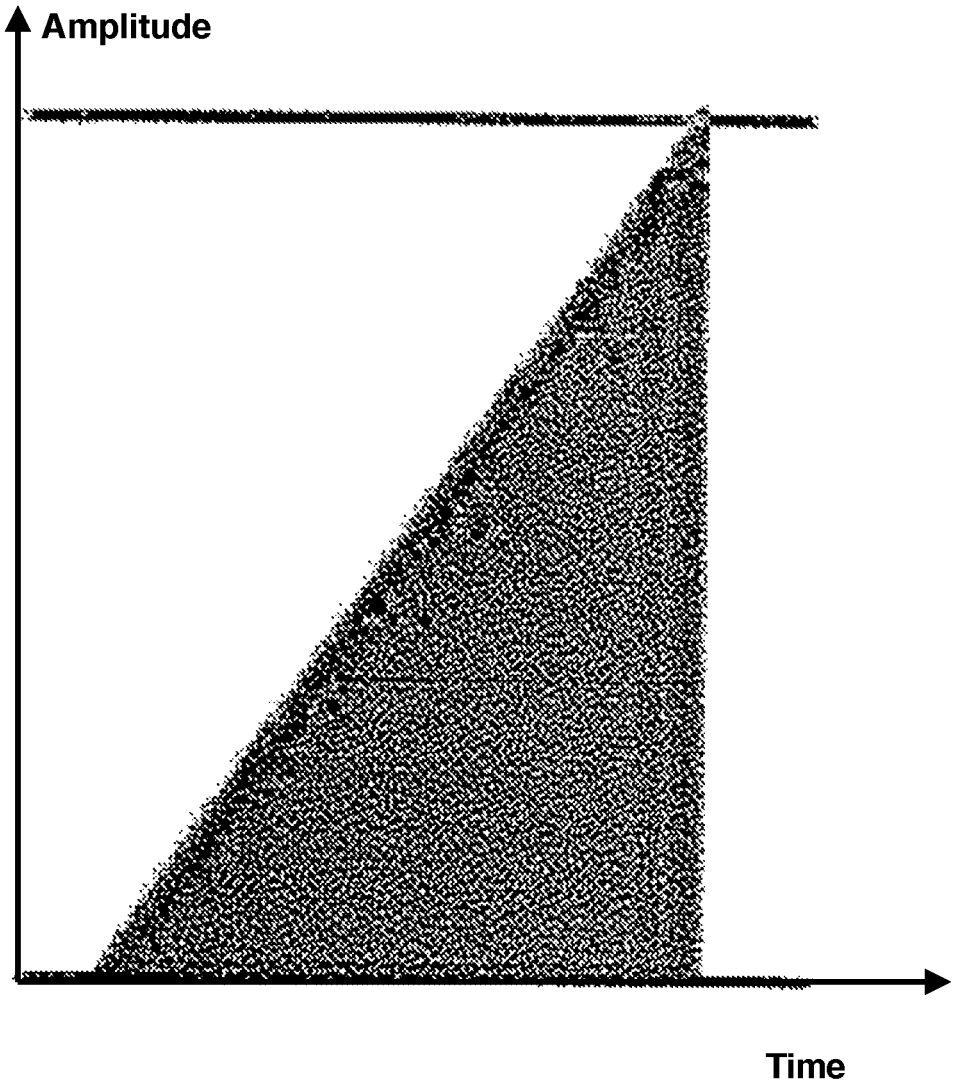
Figure 7E:
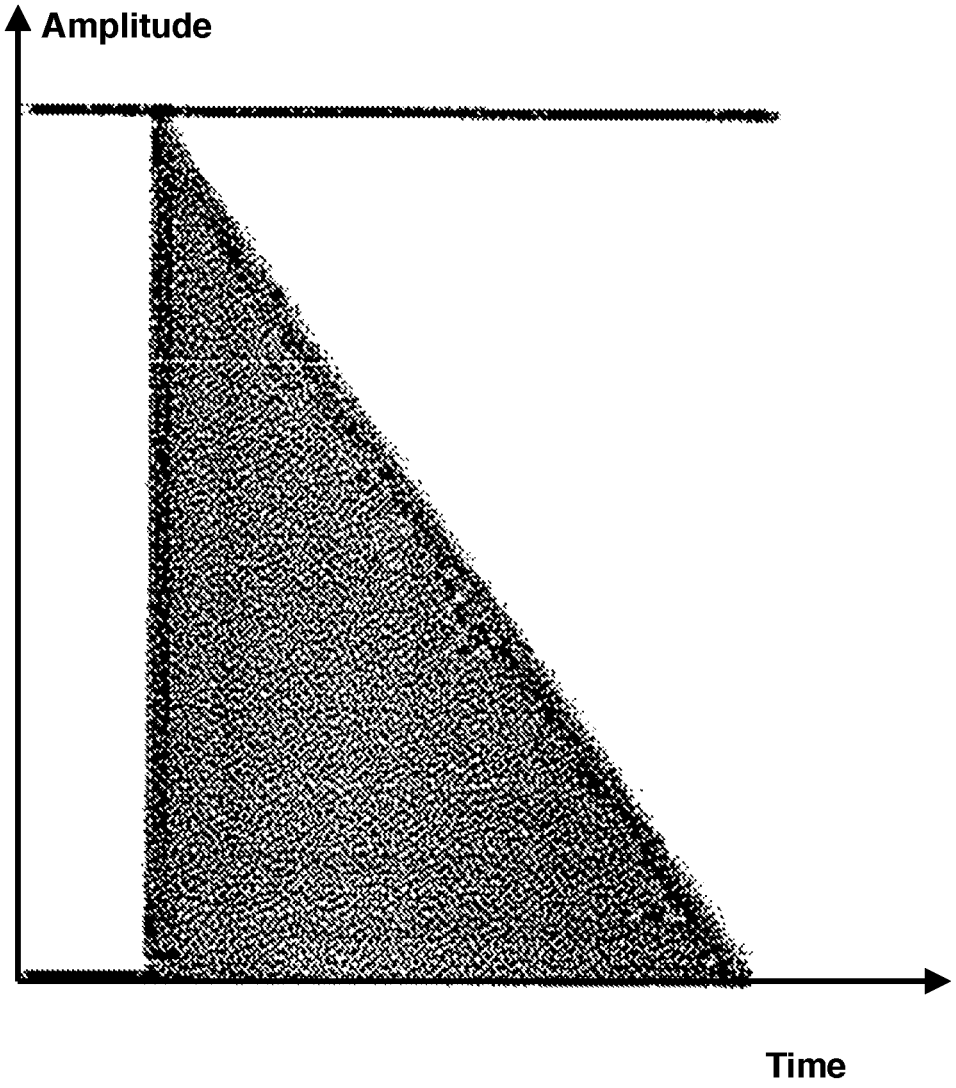
Figure 8:
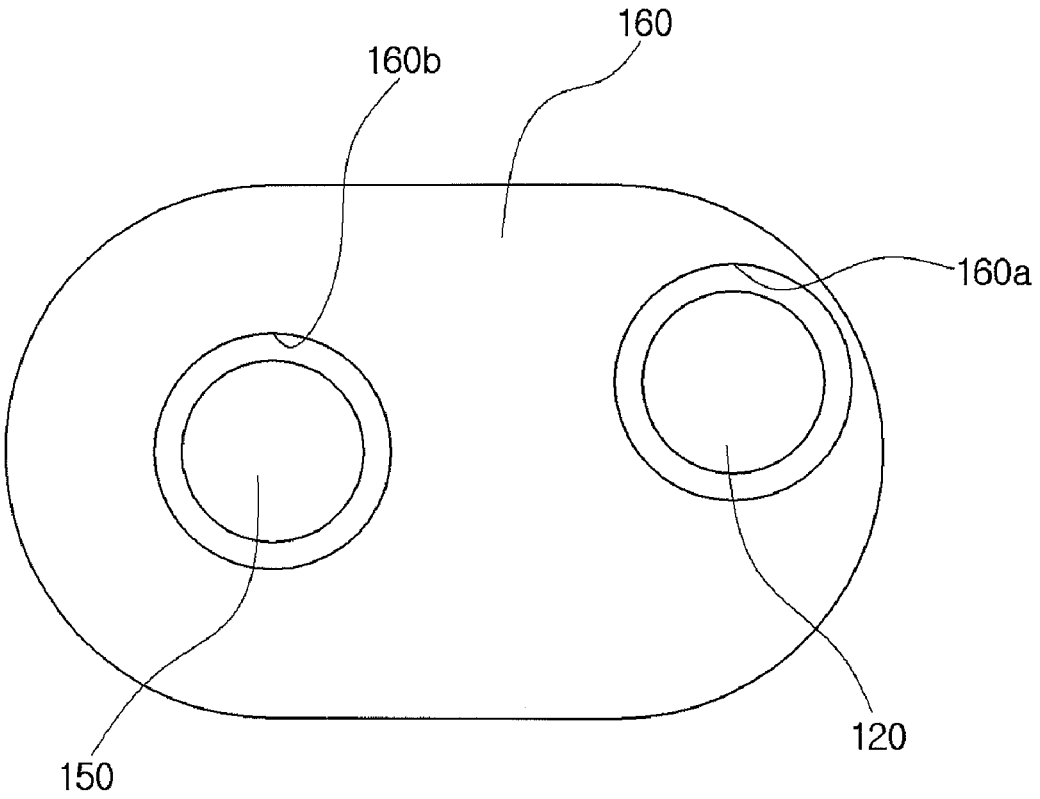
FIG. 8 is a rear side view illustrating the vibration module of the facial massage device according to the exemplary embodiment of the present invention.

FIG. 2 is a perspective view illustrating a facial massage device according to an exemplary embodiment of the present invention, FIG. 3 is an exploded perspective view illustrating the facial massage device according to the exemplary embodiment of the present invention, FIG. 4 is a sectional view taken along the line A-A of FIG. 2, FIG. 5 is a perspective view illustrating a vibration module of the facial massage device according to the exemplary embodiment of the present invention, FIGS. 7A to 7E are views showing output pulses from a controller of the vibration module of the facial massage device according to the exemplary embodiment of the present invention, and FIG. 8 is a rear side view illustrating the vibration module of the facial massage device according to the exemplary embodiment of the present invention.

As illustrated in FIG. 2, a facial massage device according to an exemplary embodiment of the present invention includes a mask 200 and a plurality of vibration modules 100 and configurations and operations of elements thereof will be described with reference to FIG. 2.

The mask 200 forms an accommodation space for the vibration modules 100 such that the vibration modules 100 are accommodated in the accommodation space of the mask 200 and provide massage function to human face during vibration. At least one vibration module 100 may be provided and has own power supply to be driven independently. Due to this, the facial massage device drives the vibration modules 100 of the mask 200 without an external power supply to provide various massage functions and massages a specific portion of human face or the other portion excluding the specific portion.

The facial massage device according to the exemplary embodiment of the present invention will be described with reference to FIGS. 2 to 8.

Referring to FIGS. 2 to 4, the facial massage device includes a first mask 210, a second mask 220, and vibration modules 100. The facial massage device may further include a wearing unit 300.

The first mask 210 and the second mask 220 are fixed by the circumstance of the mask to form the accommodation space therein. At least one of the first mask 210 and the second mask 220 has insertion holes allowing the vibration modules 100 to be inserted or withdrawn therethrough or insertion holes 210*a* through which insulators 180 of the vibration modules are withdrawn out. In this embodiment, the first mask 210 has the insertion holes 210*a* for withdraw of the insulators 180.

Figure 6:
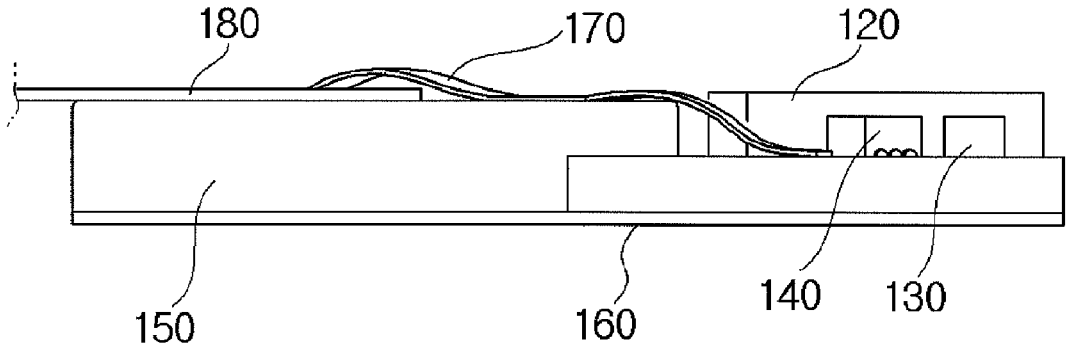
FIG. 6 is a side view of the vibration module of FIG. 5.

The vibration modules 100 will be described with FIGS. 5 to 8. Referring to FIGS. 5 and 6, each of the vibration modules 100 includes a printed circuit board 110, a vibrator 120, a drive 130, a controller 140, a battery 150, a supporting plate 160, a power connecting member 170, and an insulator 180.

The printed circuit board 110 is configured such that the vibrator 120 is installed on a side thereof and the drive 130 and the controller 140 are mounted thereon. Thus, the printed circuit board 110 has a circuit pattern for electrical connection between the battery 150, the drive 130, and the controller 140. The printed circuit board 110 may be a flexible printed circuit board (FPCB) for the purpose of allowing the vibration modules 100 being bent along contours of a user's face and closed attached thereto.

The vibrator 120 is installed on the printed circuit board 110 and vibrates by receiving an electric power by the driver 130. The vibrator 120 is a device stimulating user's skin with vibration therefrom. That is, the vibrator 120 is not only a device of the vibration module 100 directly performing facial massage but also a device transmitting power the facial massage to the whole vibration module 100. The vibrator 120 may be inserted into vibrator holes 160*a* formed in the printed circuit board 110 and the supporting plate 160.

This is because of reduction of overall thickness of the vibration module of the facial massage device 100, and in other words, the overall thickness of the vibration module 100, when the vibrator 120 is installed on a side of the printed circuit board 110, becomes sum of the thickness of the vibrator 120 and the thicknesses of the printed circuit board 110 and the supporting plate 160. Thus, the vibrator holes 160*a* are formed in the printed circuit board 110 and the supporting plate 160 and the vibrator 120 is inserted into the vibrator holes 160*a* and the thicknesses of the printed circuit board 110 and the supporting plate 160 is subtracted from the overall thickness of the vibration module 100 so that the overall thickness of the vibration module 100 can be reduced.

The drive 130 is mounted on the printed circuit board 110 and received electric power from the battery 150 to supply the received electric power to the vibrator 120. The drive 130 may be any one of a vibration motor, a solenoid, a piezo device, and a linear vibrator.

The controller 140 is mounted on the printed circuit board 110 and controls the drive 130 to adjust vibration of the vibrator 120. The controller 140 controls the drive 130 in pulse width modulation (PWM). That is, the controller 140 operates the drive 130 in various modes through the PWM, while outputting at least two different pulses wherein the different output pulses are sequentially outputted or only a preset one type pulse is continuously outputted. The vibrator 120 may vibrate to provide various massage functions such as appeasing, rubbing, picking, pressing, knocking, etc., according to the various output pulses and the operating conditions of the drive 130.

As illustrated in FIG. 7, FIGS. 7A to 7H are views showing massage operations of the vibrator which vibrates in different types according to output pulses outputted from the controller 140 to the drive 130. That is, the colored portions in the drawings are portions to which vibration of the vibrator is transmitted and the other portion is portion where the vibrator is stopped or not attached.

Figure 7F:
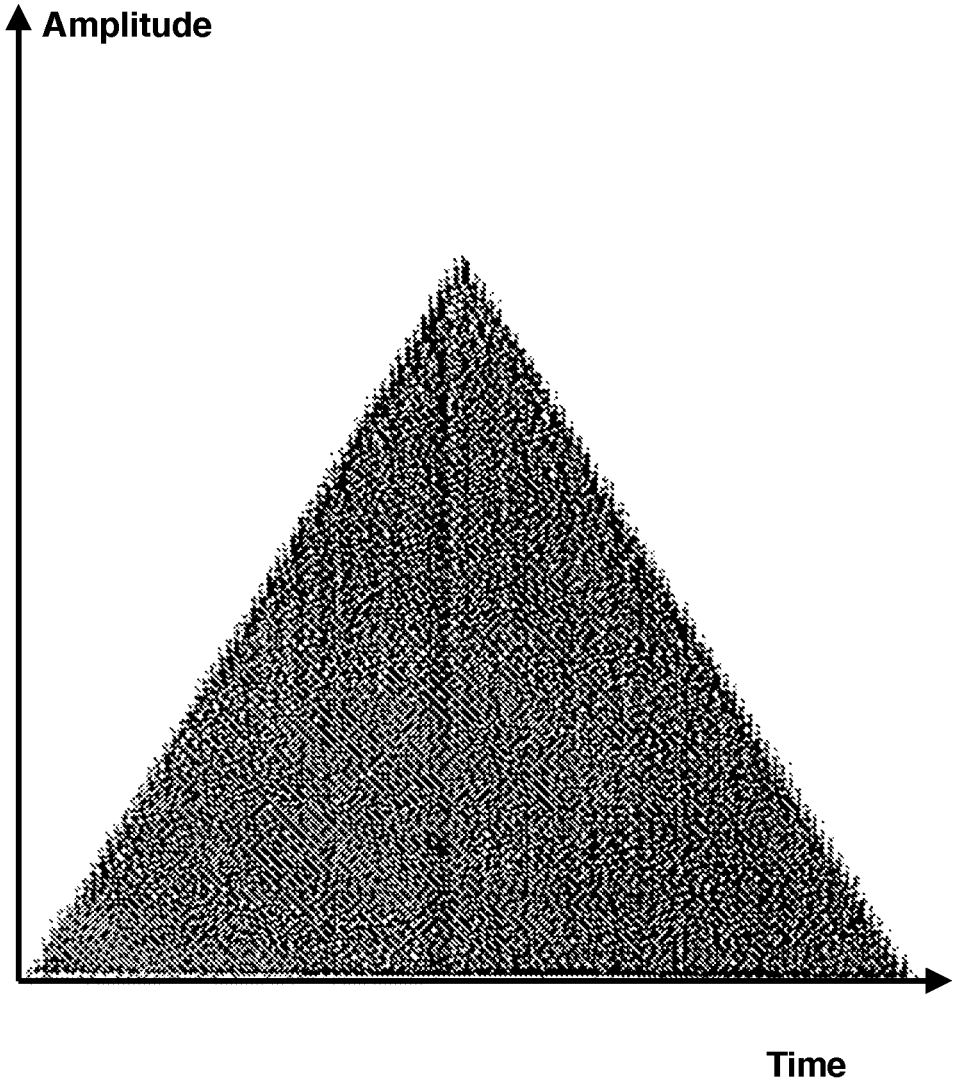
Figure 7G:
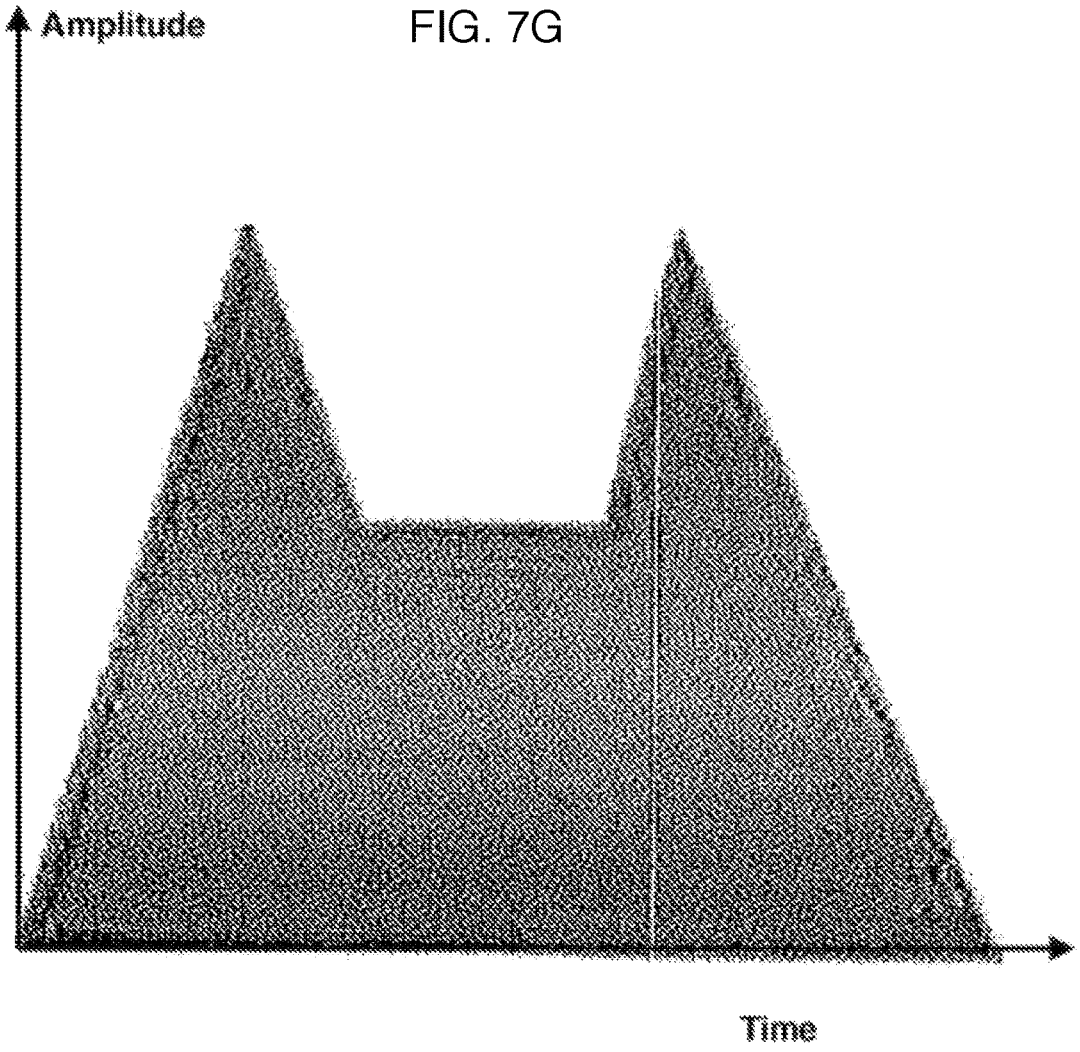
Figure 7H:
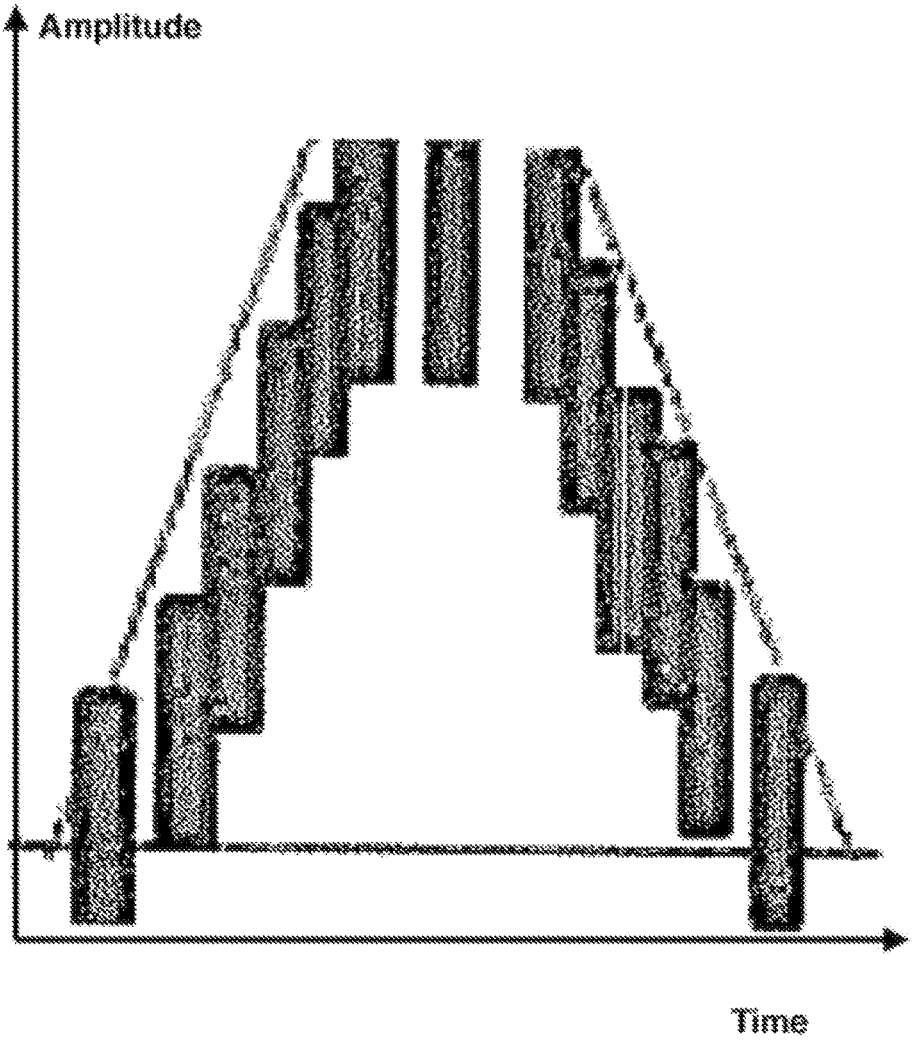

FIG. 7A shows a case where relatively strong vibration continues same intensity for a preset time, FIG. 7B shows relatively strong vibration of same intensity repeated every preset short time interval, and FIG. 7C shows relatively strong vibration of same intensity repeated for a preset time every short time interval. Moreover, FIG. 7D shows visually weak vibration being gradually stronger for a preset time after starting and FIG. 7E shows strong vibration being gradually weakening for a preset time after starting contrary to the case of FIG. 7D. FIG. 7F shows early weak vibration is gradually stronger to the peak and is gradually weakened again.

Return to FIGS. 5 and 6, the battery 150 is installed on the supporting plate 160 and supplies electric power to the drive 130 and the controller 140 through the power connecting member 170. The battery 150 may be inserted into a battery hole 160*b* formed in the supporting plate 160 so as to reduce the overall thickness of the vibration module 100 and its description is omitted because this is substantially identical to the insertion of the vibrator 120 into the vibrator holes 160*a*.

The supporting plate 160 is provided to connect the printed circuit board 110 to the battery 150 integrally. The supporting plate 160 may be made of a flexible material such that flexibility of the vibration module 100 can be guaranteed. Moreover, the supporting plate 160 may be configured such that the battery 150 and the vibrator 120 are mounted at the ends in the major axis on an oval side of the supporting plate 160, respectively. Thus, devices are not mounted at the middle portion of the major axis and due to this the supporting plate 160 can exhibit elasticity and higher flexibility.

The power connecting member 170 electrically connects the power terminals (not shown) of the battery 150 to the power terminals (not shown) of the drive 130 on the printed circuit board 110. In other words, the drive 130 receives electric power from the battery 150 through the power connecting member 170. Moreover, the power terminals of the printed circuit board 110 may supply electric power to the controller 140 and in this case the printed circuit board 110 has circuit patterns connecting the power terminals to the drive 130 and the controller 140 in parallel.

The insulator 180 is attached to a contact area between the power terminals of the battery 150 and the power connecting member 170. That is, the insulator 180 is attached to the battery 150 to interrupt the electrical connection between the power terminals of the battery 150 and the power connecting member 170 and the electrical connection between the power terminals of the battery 150 and the insulator 180 is made when the insulator 180 is separated from the battery 150. The insulator 180 is detachably attached to the battery 150 and controls the electrical connection between the power terminals of the battery 150 and the power connection member 170 through the attachment and detachment of the insulator 180 to control the electric power to be supplied from the battery 150 to the drive 130 or not.

In other words, the insulator 180 can switch the electrical connection between the power terminals of the battery 150 and the power connecting member 170 and in this case the vibration module 100 can spend the electric power of the battery 150 only by the switching function of the insulator 180 even without a separated switch. That is, omission of the switch allows reduction of volume of the vibration module 100 and the electric power of the battery 150 may be spent only when the vibrator 120 is operated.

Although in this exemplary embodiment a thin sheet of the insulator 180 is detachably attached to the battery 150 to screen the power terminals, the present invention is not limited thereto but the insulator 180 may be attached to and detached from power terminal regions of the battery 150 and may be modified under the conditions of applying electric power between the power terminals of the battery 150 and the power connecting member 170.

FIG. 8 is a rear side view of the vibration module of the facial massage device according to the exemplary embodiment of the present invention in which the battery 150 and the vibrator 120 are inserted into the battery hole 160*b* and the vibrator holes 160*a* that are formed in the printed circuit board 110 and the supporting plate 160 and are fixed thereto. A buffering pad (not shown) may be attached to the rear side of the vibration module 100 (the rear side of the supporting plate) and may prevent direct contact between the vibrator 120 and human skin. In FIG. 8, the buffering pad is omitted for the purpose of showing the battery hole 160*b* and the vibrator holes 160*a* and ones of sides of the battery 150 and the vibrator 120 which are inserted thereinto. Moreover, the buffering pas may be made in various types such as non-woven fabric or a sheet containing liquid material.

Referring to FIGS. 2 to 4 again, the wearing unit 300 puts the mask on a human head and is like a hair band in this embodiment, but the present invention is not limited thereto. The wearing limit 300 consists of a pair of bands, ends of which are fixed to lateral sides of the mask 200 and the other ends of which are provided with hook and loop fasteners 310 for connecting each other. Lengths of the hook and loop fasteners are relatively long such that length of the wearing unit 300 cab e adjusted by contact portions between the hook and loop fasteners 310.

As described with reference to FIGS. 2 to 8, the facial massage device of the present invention can exhibit massage functions by driving a plurality of vibration modules 100 of the mask 200 which are independently driven by own power supply even without a separated external power supply. Moreover, since a plurality of vibration modules 100 massage a specific portion of human face or the other portion excluding the specific portion by user's choice, the facial massage device of the present invention can provide proper massage functions according to face skin conditions and personal tendency.

In addition, since the drives of the vibration modules 100 are controlled in pulse width modulation (PWM) to drive the vibrators receiving power from the drives to be operated in various vibration patterns, the facial massage device of the present invention can provide various massage function such as appeasing, rubbing, picking, pressing, and knocking by controlling vibration patterns of the vibration modules.

While this invention has been particularly shown and described with reference to preferred embodiments thereof, these embodiments are provided so that this disclosure will be thorough and complete, and will fully convey the concept of the invention to those skilled in the art. It will be understood by those skilled in the art that various changes in form and details may be made therein without departing from the spirit and scope of the invention as defined by the appended claims.

What is claimed is:

1. A facial massage device, comprising:

a face mask having a first layer attached to a second layer with an accommodation space in between, wherein the second layer is adapted to contact a user's face, and the first layer is located opposite the second layer, and the first layer has a plurality of insertion slits that penetrate through the first layer;

a plurality of vibration modules positioned within the accommodation space of the face mask between the first layer and second layer, each of the vibration modules comprising:

a printed circuit board;

a battery configured to generate electric power;

a drive mounted on the printed circuit board, the drive configured to receive the electric power from the battery;

a vibrator mounted on the printed circuit board, the vibrator being configured to create a vibration force upon receipt of the electric power from the drive;

a power connecting member electrically connecting the battery to the drive on the printed circuit board, the power connecting member providing an electrical connection between the battery and the drive; and an insulator detachably attached to a contact region between the battery and the connecting member, the insulator interrupting the power connection between the battery and the drive, the power connection between the battery and the drive being established only when the insulator is separated from the contact region between the battery and connecting member; and wherein the insulator of each of the vibration modules extends out through each of the respective insertion slits of the first layer of the face mask;

wherein each of the insertion slits is sized to allow the vibration modules to be inserted or withdrawn therethrough.

2. The facial massage device of claim 1, wherein the vibration module further comprises a controller controlling the drive to control a vibration state of the vibrator, and the controller controls the drive in pulse width modulation (PWM), wherein the pulse width modulation includes (i) a first mode of operation in which at least two different pulses are sequentially outputted, and (ii) a second mode of operation in which a pulse is outputted continuously.

3. The facial massage device of claim 1, further comprising a wearing unit for allowing the mask to be put on a human head.

4. The facial massage device of claim 1, wherein the printed circuit board includes first and second surfaces, the second surface being mounted on a support plate, and the first surface having at least one hole defined therein;

wherein the vibrator is mounted in the at least one hole in the first surface; and wherein a height of the vibration module comprises a sum of a height of the support plate, a height of the printed circuit board, and a height of a portion of the vibrator extending above the first surface.

* * * * *